US005709778A

United States Patent [19]

Kade et al.

[11] Patent Number: 5,709,778

[45] Date of Patent: Jan. 20, 1998

[54] MULTIPLE SHOE PRESS FOR A PAPER MAKING MACHINE

[75] Inventors: Werner Kade, Neenah; Edwin X. Graf, Menasha, both of Wis.

[73] Assignee: Voith Sulzer Paper Technology North America, Inc., Appleton, Wis.

[21] Appl. No.: 741,059

[22] Filed: Oct. 30, 1996

[51] Int. Cl.[6] ..... D21F 3/06

[52] U.S. Cl. ..... 162/358.3; 162/361

[58] Field of Search ..... 162/205, 358.3, 162/358.4, 358.5, 358.2, 361

[56] References Cited

U.S. PATENT DOCUMENTS

| | | | |
|---|---|---|---|
| 3,783,097 | 1/1974 | Justus | 162/358.3 |
| 3,970,515 | 7/1976 | Busker | 162/358.3 |
| 3,974,026 | 8/1976 | Emson et al. | 162/358 |
| 4,425,190 | 1/1984 | Cronin | 162/358 |
| 4,492,611 | 1/1985 | Meinander | 162/358.3 |
| 4,556,454 | 12/1985 | Dahl et al. | 162/358.3 |
| 4,568,423 | 2/1986 | Laapotti | 162/358.3 |
| 5,071,513 | 12/1991 | Bluhm et al. | 162/358.5 |

FOREIGN PATENT DOCUMENTS

| | | | |
|---|---|---|---|
| 218918 | 2/1985 | Dominican Rep. | 162/358.3 |
| 44 23 213 | 7/1994 | Germany | F16C 13/00 |
| 44 23 694 | 7/1994 | Germany | D21F 3/02 |
| 2071293 | 9/1981 | United Kingdom | 162/358.2 |

*Primary Examiner*—Karen M. Hastings

*Attorney, Agent, or Firm*—Taylor & Associates, P.C.

[57] ABSTRACT

The invention is directed to a shoe press for removing water from a traveling fiber web. The shoe press includes a planar backing surface, and a shoe assembly disposed adjacent to the backing surface. The shoe assembly and the backing surface form a press nip therebetween extending in a running direction of the traveling fiber web. Four felts extend through the press nip and carries the fiber web through the press nip. The shoe assembly includes a plurality of shoes disposed adjacent to each other in the running direction of the fiber web, with each shoe being configured to apply a selected and independent compressive force against the at least one felt and the fiber web.

1 Claim, 4 Drawing Sheets

MULTIPLE SHOE PRESS FOR A PAPER MAKING MACHINE

BACKGROUND OF THE INVENTION

1. Field of the Invention

The present invention relates to paper making machines, and, more particularly, to a shoe press for use in paper making machines.

2. Description of the Related Art

A shoe press for a paper making machine typically includes two felts which are carried by respective rolls defining a press nip therebetween. A fiber web, such as a paper web, is disposed between the two felts extending through the press nip defined by the two rolls. A shoe associated with one of the rolls exerts a compressive force on the fiber web as it travels through the press nip, resulting in some of the water in the fiber web being absorbed by the two felts.

With a shoe press as described above, one of the rolls typically defines a backing roll, and the other roll defines a pressing roll. The shoe is associated with the pressing roll and is in the form of a single shoe which applies a single compressive force on the felts and the fiber web in a direction which is substantially perpendicular to the shell surface of the backing roll at the press nip. The felt which is disposed adjacent to the single shoe is carried through the press nip by a fluid impermeable belt which rotates around the pressing roll. A predetermined compressing force is applied to the belt, felts and fiber web at the press nip to cause some of the water in the fiber web to be absorbed by the felts disposed on either side thereof.

It is known to provide the single shoe of a shoe press with a particular geometry on the surface adjacent the press nip such that a desired pressure profile curve may be applied against the fiber web traveling through the press nip. However, the pressure profile curve exerted on the fiber web at the press nip is limited by geometric constraints associated with the single shoe. Further, only a single compressive force is applied to the single shoe, which in turn is transferred to the fiber web at the press nip.

It is also known to provide a belt press in a paper machine including a single pressure member with a concave face having a shape which is complimentary to the shape of the opposing backing roll. The pressure member includes two chambers in which a relatively incompressible fluid is disposed. The chambers are disposed adjacent to each other in the running direction of the machine, and may include different fluid operating pressures therein. Since the pressure member in essence acts as a beam with different loads being applied at opposite ends thereof, the pressure member moves to an equilibrium position such that a uniform spacing is provided at the press nip and a resultant equilibrium loading is applied to the fiber web at the press nip. Such a belt press is described in U.S. Pat. No. 3,974,026 (Emson, et al.), which is assigned to a predecessor company of the assignee of the present invention.

What is needed in the art is a shoe press which allows greater effectiveness; that is, residence time to reduce or eliminate previous and subsequent nips, thereby physically shortening the press section in the running direction of the machine.

SUMMARY OF THE INVENTION

The present invention provides a shoe press having a plurality of shoes arranged in the running direction of the fiber web which are configured to apply selected and independent compressive forces to the fiber web.

The invention comprises, in one form thereof, a shoe press for removing water from a traveling fiber web. The shoe press includes a backing surface, and a shoe assembly disposed adjacent to the backing surface. The shoe assembly and the backing surface form a press nip therebetween extending in a running direction of the traveling fiber web. At least one felt extends through the press nip and carries the fiber web through the press nip. The shoe assembly includes a plurality of shoes disposed adjacent to each other in the running direction of the fiber web, with each shoe being configured to apply a selected and independent compressive force against the at least one felt and the fiber web.

An advantage of the present invention is that more than one selected compressive force is applied by the shoe press to the fiber web in the running direction, thereby allowing compressive forces with a desired pressure profile curve to be exerted against the fiber web.

Another advantage of the present invention is that the selected compressive forces which are applied by the shoe press to the fiber web in the running direction are independent of each other.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
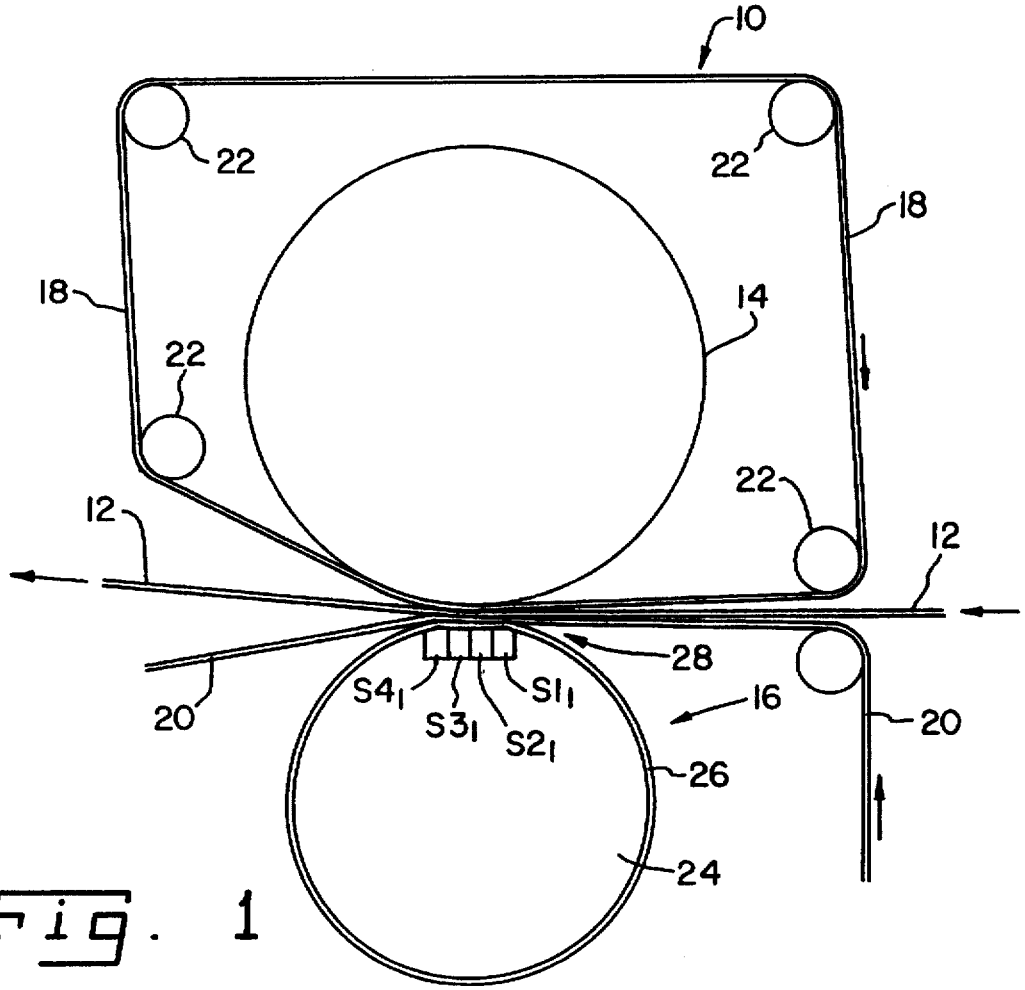
FIG. 1 is a schematic illustration of a portion of a paper making machine including an embodiment of a shoe press of the present invention.
Figure 2:
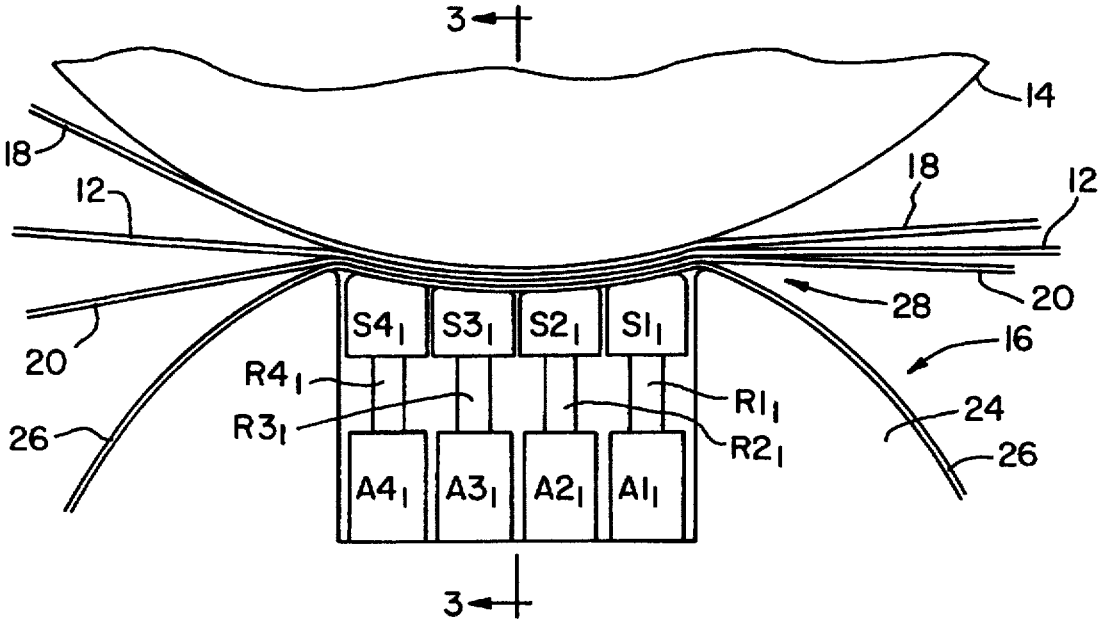
FIG. 2 is a enlarged, end view of the shoe press of the present invention shown in FIG. 1.
Figure 3:
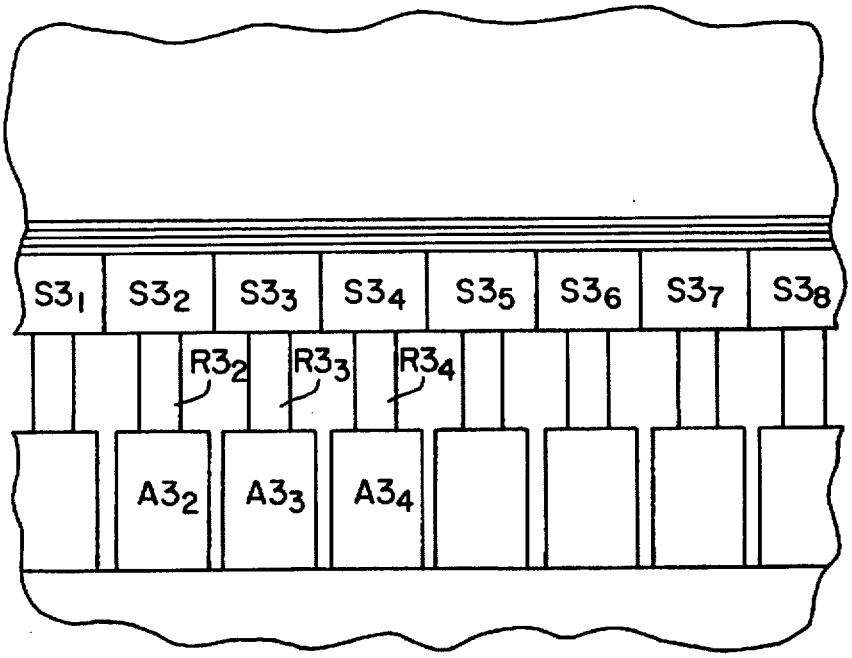
FIG. 3 is a schematic, fragmentary front view of the shoe press shown in FIGS. 1 and 2.

Referring now to the drawings, and more particularly to FIGS. 1–3, there is shown an embodiment of a shoe press 10 which forms part of a paper making machine. Shoe press 10 removes water from a traveling fiber web 12, such as a paper web, and generally includes a backing surface 14, shoe assembly 16 and a pair of felts 18, 20.

Backing surface 14, in the embodiment shown in FIGS. 1–3, is in the form of a press roll. Press roll 14, in the embodiment shown, has a diameter of about 10 feet, but could be smaller or larger depending upon the paper requirements. Press roll 14 and rolls 22 carry felt 18, which is in the form of an endless felt. Of course, at least one of rolls 22 may be movable in one or more predetermined directions to apply an appropriate tension and/or guide felt 18.

Shoe assembly 16 includes a plurality of shoes "S", four of which are shown in the end views of FIGS. 1 and 2 and referenced $S1_1$, $S2_1$, $S3_1$ and $S4_1$. Shoes $S1_1$–$S4_1$ are disposed adjacent to each other in the running direction of the fiber web. Each shoe $S1_1$–$S4_1$ is disposed in a row of shoes extending in a cross-machine direction. For purposes of discussion, each shoe "S" includes a reference number thereafter indicating a particular shoe of shoes (FIG. 2). Moreover, each individual shoe within a particular row of shoes is indicated by a subscript reference number for that particular shoe (FIG. 3.). Each shoe in rows S1–S4, in the embodiment shown, has a cross sectional area (viewed from the top of FIGS. 2 and 3) of approximately 8 inches by 8 inches. Moreover, the spacing between each row of shoes S1–S4 in the running direction of fiber web 12, as well as the spacing between each shoe "S" in a particular row S1–S4 is between approximately 0.10 and 0.250 inch, and more preferably approximately 0.050 inch.

Each row of shoes S1–S4 is connected to a stationary roll 24. More particularly, and referring to FIG. 2, each separate shoe $S1_1$–$S4_1$ is connected to roll 24 via rams $R1_1$–$R4_1$ and hydraulic actuators $A1_1$–$A4_1$. As shown in FIG. 3 with reference to the row of shoes S3, each shoe within a particular row is associated with a respective ram "R" and hydraulic actuator "A". The hydraulic actuators are connected to a source of hydraulic fluid (not shown) and an external controller (not shown). Hydraulic actuators A1–A4 move rams R1–R4 and shoes S1–S4 in directions toward and away from backing surface 14.

Roll 24 carries a fluid impermeable belt 26, such as an elastomeric belt, about the periphery thereof. Belt 26, such as an elastomeric belt, rotates about the periphery of roll 24, and is disposed adjacent to the rows of shoes S1–S4. Suitable structure (not shown) may be provided for lubricating belt 26 and thereby inhibiting over heating of belt 26 as it rotates around roll 24.

Shoe assembly 16 and press roll 14 form a press nip 28 therebetween which extends in the running direction of traveling fiber web 12. Fiber web 12 is disposed adjacent to felt 18 associated with press roll 14. Fiber web 12 is also disposed adjacent to a second felt 20 on the opposite side thereof. Felt 20 is thus disposed between belt 26 and fiber web 12.

Each shoe within a row of shoes S1–S4 defines a composite, concave pressing surface, viewed in the running direction of fiber web 12, which is complimentary in shape to press roll 14. That is, in the embodiment shown, the shoes within each row of shoes S1–S4 define a composite, concave surface which is parallel to and spaced apart from the outside shell surface of press roll 14. Each shoe "S" is configured to apply a selected and independent compressive force against felts 18, 20 and fiber web 12 extending through press nip 28. It is thus possible with the present invention to establish virtually any desired pressure profile curve within press nip 28. It has been found particularly advantageous by the present inventor to establish a pressure profile curve within press nip 28 such that a compressive force exerted with each row of shoes S1–S4 increases in the running direction of the traveling fiber web; however, other pressure profile curves may also be established within press nip 28 depending upon the particular application.

Figure 4:
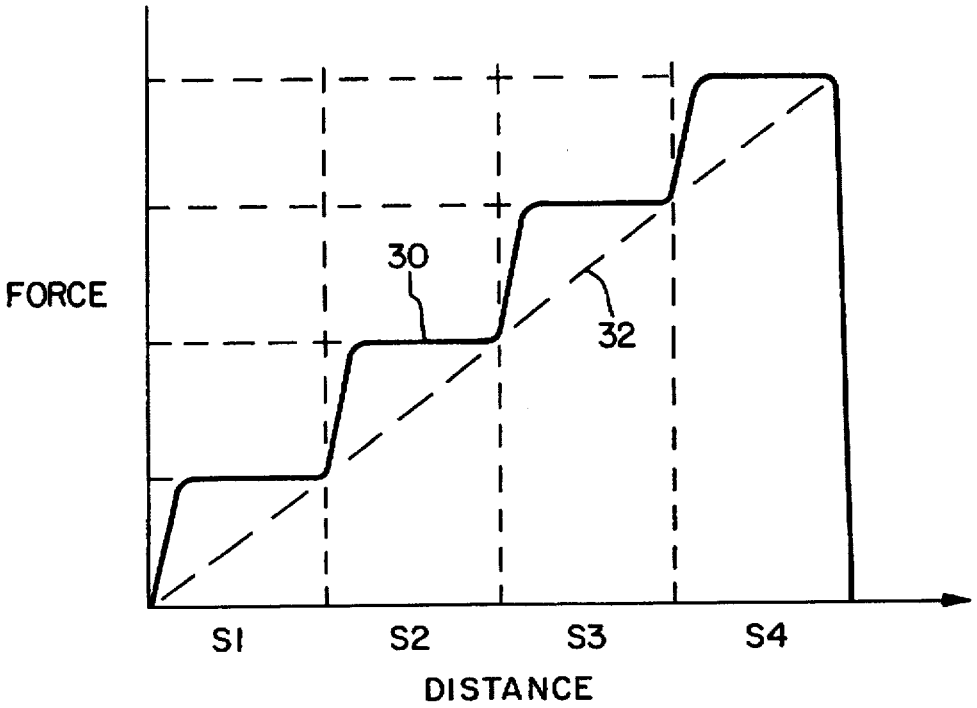
FIG. 4 is a graph illustrating exemplary pressure profile curves which may be achieved using the shoe press of the present invention shown in FIGS. 1–3.

FIG. 4 is a graphical illustration of exemplary pressure profile curves which may be achieved at press nip 28 using shoe press 16 of the present invention. The horizontal axis represents the independent distance variable associated with the distance from the entrance end to the exit end in press nip 28. The distance is divided into four zones representing the distance in the traveling direction across each row of shoes S1–S4. The vertical axis represents the dependent force variable associated with the compressive force which is exerted on felts 18, 20 and fiber web 12 in press nip 28. Solid line curve 30 illustrates a stepped profile curve corresponding to compressive forces which are conjunctively exerted on felts 18, 20 and fiber web 12 in press nip 28. The compressive force exerted on fiber web 12 has a value of approximately zero at the entrance end of press nip 28 and again falls off to zero at the exit end of press nip 28. The slope of the curve at the beginning of each row of shoes S1–S4 is relatively steep and plateaus off toward the end of each shoe within rows S1–S4. The pressure profile curve for each row may be substantially the same, as shown in FIG. 4, or may be different, depending upon the particular application.

Pressure profile curve 32 shown in dashed lines in FIG. 4 illustrates another possible pressure profile curve exerted by shoe assembly 16 on felts 18, 20 and fiber web 12 at press nip 28. Curve 32 is a substantially linear profile curve corresponding to the compressive forces which are exerted by each row of shoes S1–S4 on fiber web 12. The compressive force of each successive shoe has a value at the entrance thereof which is substantially equal to the compressive force value at the end of the shoe within the previous row of shoes.

In operation, felts 18, 20 are carried through press nip 28 in known fashion. Fiber web 12, carried between felts 18, 20, is squeezed therebetween as felts 18, 20 move through press nip 28. The compressive force which is exerted on fiber web 12 and felts 18, 20 may be selectively varied through press nip 28. Thus, a desired pressure profile curve may be established within press nip 28.

Figure 5:
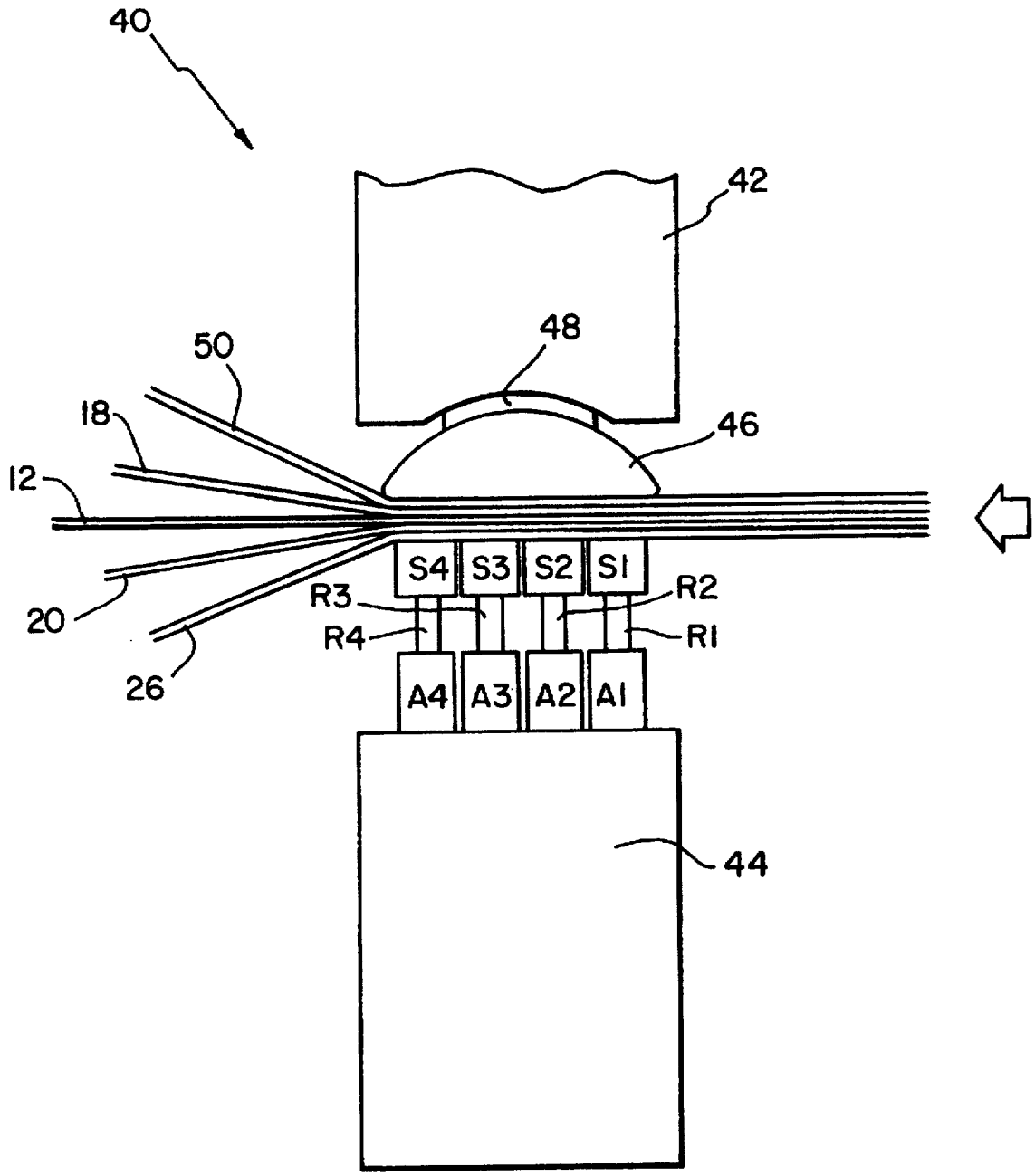
FIG. 5 is a schematic illustration of another embodiment of a shoe press of the present invention.

FIG. 5 is a schematic illustration of another embodiment of a shoe press 40 of the present invention. Similar to the embodiment of shoe press 10 shown in FIGS. 1–3, shoe press 40 includes a plurality of rows of shoes S1–S4 which are disposed adjacent to each other in the running direction of fiber web 12. However, rather than including rolls 14, 24 as shown in FIGS. 1–3, shoe press 40 shown in FIG. 5 includes respective beams 42, 44. Beam 42 is attached to a substantially D-shaped backing surface 46 via a suitable connector 48. An additional fluid impermeable belt 50 is disposed adjacent to each of backing surface 46 and felt 18.

Each shoe within the row of shoes S1–S4 is connected to beam 44 via a plurality of rams disposed within a row of rams R1–R4, and a plurality of hydraulic actuators disposed within a row of actuators A1–A4. The shoes within each row of shoes S1–S4 are configured to apply a selected and independent compressive force against felts 18, 20 and fiber web 12 in press nip 28. In contrast with the embodiment of shoe press 10 shown in FIGS. 1–3, shoe press 40 shown in FIG. 5 includes shoes "S" having a substantially flat pressing surface adjacent to press nip 28. However, similar to the embodiment of shoe press 10 shown in FIGS. 1–3, a plurality of different pressure profile curves may be established within press nip 28, such as pressure profile curves 30, 32 illustrated in FIG. 4.

Shoe press 40 shown in FIG. 5 does not require the use of rolls to carry felts 18 and 20. Beams 42, 44 which carry respective felts 18 and 20 are smaller in physical size in the running direction of fiber web 12, and thus require less physical space when used in a paper machine.

Figure 6:
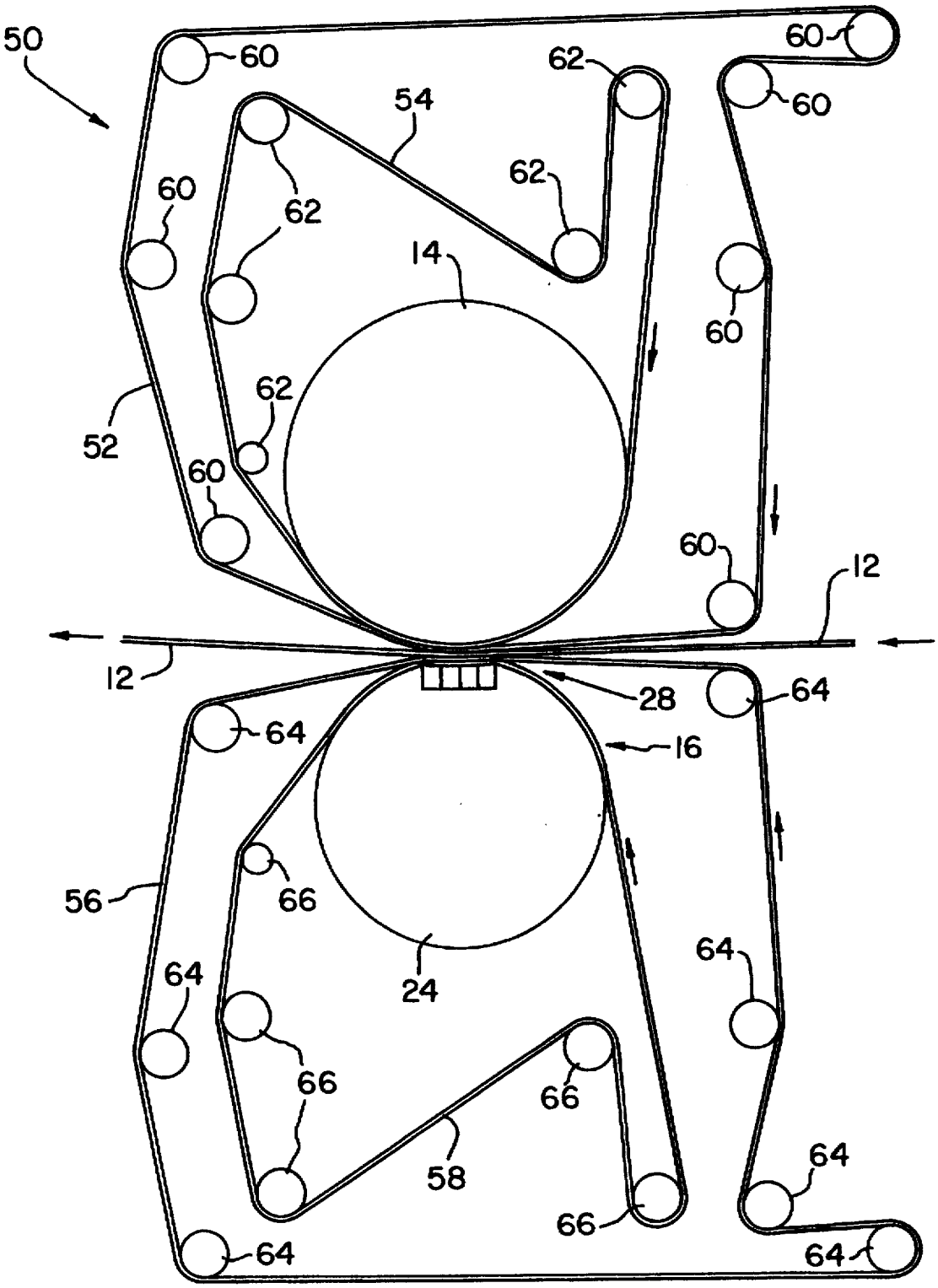
FIG. 6 is a schematic illustration of yet another embodiment of a shoe press of the present invention.

Referring now to FIG. 6, there is shown a schematic illustration of another embodiment of a shoe press 50 of the present invention. Shoe press 50 includes a backing surface or press roll 14, a roll 24 and a fiber web 12, similar to the embodiment shown in FIG. 1. However, in contrast with the embodiment of shoe press 10 shown in FIG. 1, shoe press 50 includes two pairs of felts 52, 54 and 56, 58. Felt 52 is carried by press roll 14 and a plurality of rolls 60. Similarly, felt 54 is carried by press roll 14 and a plurality of rolls 62. Likewise, felt 56 is carried by rolls 24 and 64; and felt 58 is carried by rolls 24 and 66. Of course, at least one of rolls 60, 2, 64 and/or 66 may be movable in one or more predetermined directions to apply an appropriate tension and/or guide respective felts 52, 54, 56 and 58. Shoe assembly 16 shown in FIG. 6 includes a plurality of shoes "S", referenced $S1_1$, $S2_1$, $S3_1$ and $S4_1$, similar to the respectively referenced shoes S1–S4 shown in FIGS. 1 and 2. Each row of shoes S1–S4 is connected to stationery roll 24, such as by rams and hydraulic actuators $R1_1$–$R4_1$ and $A1_1$–$A4_1$ shown in FIG. 2.

Shoe assembly 16 and press roll 14 form a press nip 28 therebetween which extends in the running direction of traveling fiber web 12. Fiber web 12 is disposed adjacent to and between felts 52 and 56. As indicated above, shoe press 50 shown in FIG. 6 differs from the embodiment of shoe press 10 shown in FIG. 1 in that press roll 14 and roll 24 each carry a pair of felts 52, 54 and 56, 58, respectively. Such a configuration allows the use of thinner felts while still maintaining a desired absorption capability at press nip 28. That is, the combined thickness of each pair of felts 52, 54 and 56, 58 at press nip 28 effects greater fluid absorption at press nip 28. Thus, rather than using a single, relatively thick felt which may be somewhat difficult to dry, or a single, thin felt which may not have adequate water absorption capabilities, the two pairs of felts 52, 54 and 56, 58 are relatively easy to dry and still provide adequate water absorption capabilities.

In the embodiments of shoe presses 10, 40 and 50 shown in the drawings, each row of shoes S1–S4 includes a plurality of shoes "S" disposed beside each other and extending in the cross-machine direction. However, it is also to be understood that each row of shoes S1–S4 may be in the form of a single shoe which extends in the cross-machine direction (with or without structural relief to allow easier flexing between zones in the cross-machine direction). Further, the plurality of shoes within a particular row of shoes S1–S4 may be loosely connected together such as by interfitting tongue and grooves, etc. Moreover, shoe assembly 16 may be provided with a different number of rows of shoes, rather than the four rows of shoes shown in the drawings. Additionally, each shoe "S" may be moved in a direction transverse to the opposing backing surface at press nip 28 using appropriate structure other than hydraulic cylinders. For example, shoes "S" may be moved in a direction transverse to the backing surface using a plurality of adjustment spindles connected to suitable motor actuators and a controller (not shown), or using a plurality of pneumatic devices connected to a controller (not shown).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed:

1. In a paper making machine, a shoe press for removing water from a traveling fiber web, said shoe press comprising:

a beam including a generally D-shaped member having a substantially planar surface defining a backing surface;

a shoe assembly disposed adjacent to said backing surface, said shoe assembly and said backing surface forming an extended substantially planar press nip therebetween extending in a running direction of the traveling fiber web, said shoe assembly including a plurality of mechanical shoes disposed adjacent to each other in the running direction of the fiber web, each said mechanical shoe having a mechanical pressing surface, each said mechanical shoe being configured to apply a selected and independence compressive force to the fiber web in said press nip, said compressive forces associated with said plurality of mechanical shoes sequentially increasing in the running direction of the traveling fiber web, said plurality of pressing surfaces being structured and arranged and said plurality of compressive forces being selected to conjunctively define a selected pressure profile curve acting on the fiber web in said press nip, said pressure profile curve being selected to define at least one of a stepped pressure profile curve and a linear pressure profile curve;

at least four felts extending through said press nip for carrying the fiber web through said press nip, two of said felts being positionable on one side of the fiber web and two other of said felts being positionable on an other side of the fiber web;

a plurality of hydraulic rams respectively connected with said plurality of mechanical shoes, each said hydraulic ram being structured and arranged to move said respective mechanical shoe in directions toward and away from said press nip; and a plurality of actuators respectively connected with said plurality of hydraulic rams, each said actuator independently effecting said movement of said respective hydraulic ram.

* * * * *

UNITED STATES PATENT AND TRADEMARK OFFICE

CERTIFICATE OF CORRECTION

PATENT NO. : 5,709,778

DATED : January 20, 1998

INVENTOR(S) : Werner Kade, et al.

It is certified that error appears in the above-identified patent and that said Letters Patent is hereby corrected as shown below:

COLUMN 5

Line 12, delete "2", and substitute --62-- therefor.

Signed and Sealed this

Twenty-first Day of April, 1998

Bruce Lehman

*Attest:*

BRUCE LEHMAN

*Attesting Officer*

*Commissioner of Patents and Trademarks*